US010688364B2

(12) United States Patent
Schmedes, III

(10) Patent No.: US 10,688,364 B2
(45) Date of Patent: Jun. 23, 2020

(54) GOLF TRAINING AID AND RELATED METHOD

(71) Applicant: Bill Schmedes, III, Hackettstown, NJ (US)

(72) Inventor: Bill Schmedes, III, Hackettstown, NJ (US)

( * ) Notice: Subject to any disclaimer, the term of this patent is extended or adjusted under 35 U.S.C. 154(b) by 0 days.

(21) Appl. No.: 15/952,907

(22) Filed: Apr. 13, 2018

(65) Prior Publication Data

US 2019/0314701 A1 Oct. 17, 2019

(51) Int. Cl.

| | |
|---|---|
| ***A63B 69/36*** | (2006.01) |
| ***A63B 53/04*** | (2015.01) |
| ***A63B 60/06*** | (2015.01) |
| ***A63B 71/06*** | (2006.01) |
| *A63B 102/32* | (2015.01) |

(52) U.S. Cl.

CPC ..... *A63B 69/36* (2013.01); *A63B 53/047* (2013.01); *A63B 60/06* (2015.10); *A63B 71/0622* (2013.01); *A63B 2053/0433* (2013.01); *A63B 2053/0441* (2013.01); *A63B 2071/0694* (2013.01); *A63B 2102/32* (2015.10); *A63B 2209/00* (2013.01)

(58) Field of Classification Search

CPC ..... A63B 53/04
USPC ..... 473/219, 257
See application file for complete search history.

(56) References Cited

U.S. PATENT DOCUMENTS

| | | | | |
|---|---|---|---|---|
| 4,932,659 | A | 6/1990 | Freeberg | |
| 5,158,297 | A | 10/1992 | Johnson | |
| 5,228,695 | A * | 7/1993 | Meyer | A63B 53/00 473/238 |
| 6,447,401 | B1 | 9/2002 | Torkos | |
| 6,754,970 | B2 | 6/2004 | Daniels | |
| 7,416,492 | B2 | 8/2008 | Wesley | |
| 7,481,715 | B2 | 1/2009 | Byrne | |
| 7,537,525 | B2 | 5/2009 | Wang | |
| 8,241,138 | B2 * | 8/2012 | Maglaque | A63B 69/3617 473/201 |
| 8,337,319 | B2 | 12/2012 | Sargent et al. | |
| 8,939,847 | B2 | 1/2015 | Sander et al. | |
| 9,174,096 | B2 | 11/2015 | Sargent et al. | |
| 9,308,430 | B2 | 4/2016 | Nivanh | |
| 9,814,944 | B1 | 11/2017 | Greaney et al. | |
| 2005/0107180 | A1 | 5/2005 | Halleck et al. | |
| 2011/0059808 | A1 * | 3/2011 | Roach | A63B 53/00 473/238 |
| 2013/0196784 | A1 | 8/2013 | Clausen et al. | |
| 2015/0057097 | A1 * | 2/2015 | Cho | A63B 53/047 473/324 |

* cited by examiner

*Primary Examiner* — Raeann Gorden
(74) *Attorney, Agent, or Firm* — Venable LLP; Michele V. Frank

(57) ABSTRACT

A golf training club has a shaft having a proximal end and a distal end. The shaft defines a longitudinal axis. A club head is coupled to the distal end, the club head having a sole, a club face, and an upper surface. An address alignment gauge extends along the longitudinal axis of the shaft. The club face defines a closed face angle about the longitudinal axis of the shaft with respect to the address alignment gauge that is between about 20 degrees and about 40 degrees. A lie angle between the shaft and ground surface is between about 55 and 75 degrees.

12 Claims, 7 Drawing Sheets

GOLF TRAINING AID AND RELATED METHOD

TECHNICAL FIELD

The present application relates generally to a golf training aid. More specifically, the present application relates to a golf club having a closed face angle and a method of using the golf club.

BACKGROUND

When golfing, it is often desired to hit the golf ball with a square club face when impacting the golf ball. It is also desired for the golf club to follow the proper swing form and path to achieve the desired trajectory. For example, when using a golf iron, a desired golf swing begins with minimal shaft lean towards the target at address, but increase in the lean of the shaft at impact. This allows for a square club face at impact and a downward strike on the golf ball allowing for improved contact and further distances. This may be difficult for golfers to attain. For example, golfers may have a tendency to setup improperly or poorly with the shaft tilted away from the target at impact causing poor clubface angles, poor angles of attack, poor strikes on the clubface, and loss of distance. This may result in unintentionally slicing or hooking the golf ball. Thus a need exists for a golf club which may assist a golfer in correcting or improving their swing from address to impact.

SUMMARY

According to an embodiment, a golf training club may include a shaft having a proximal end and a distal end, the shaft defining a longitudinal axis; a club head coupled to the distal end, the club head having a sole, a club face, and an upper surface; and an address alignment gauge extending along the longitudinal axis of the shaft. The club face defines a closed face angle about the longitudinal axis of the shaft with respect to the address alignment gauge that is between about 20 degrees and about 40 degrees. A lie angle between the shaft and ground surface is between about 55 and about 75 degrees.

According to an embodiment, a golf training club may include a shaft having a proximal end and a distal end, the shaft defining a longitudinal axis; a club head coupled to the distal end, the club head having a club face and an upper surface; an address alignment gauge extending along the longitudinal axis of the shaft; and an impact alignment gauge extending the upper surface of the club head. The impact alignment gauge defines a closed face angle about the longitudinal axis of the shaft with respect to the address alignment gauge that is between about 20 degrees and about 40 degrees.

According to an embodiment, a golf training method may include providing a golf training club having: a shaft defining proximal and distal ends, a club head coupled to the distal end of the shaft, an address alignment gauge extending along a longitudinal axis of the shaft, and an impact alignment gauge extending along an upper surface of the club head, addressing a golf ball with the golf training club, with the address alignment gauge pointing perpendicular to the intended trajectory of the golf ball; and impacting the golf ball with the golf training club, with the impact alignment gauge pointing perpendicular to the intended trajectory of the golf ball.

BRIEF DESCRIPTION OF THE DRAWINGS

The foregoing aspects and other features and advantages of the invention will be apparent from the following drawings, wherein like reference numbers generally indicate identical, functionally similar, and/or structurally similar elements.

DETAILED DESCRIPTION

Embodiments of the invention are discussed in detail below. In describing embodiments, specific terminology is employed for the sake of clarity. However, the invention is not intended to be limited to the specific terminology so selected. A person skilled in the relevant art will recognize that other equivalent parts can be employed and other methods developed without departing from the spirit and scope of the invention.

Embodiments of the present invention relate to a golf training club having a closed face at an address position. The club face may be altered to a square position when a golfer moves the golf club from the address position to the impact position. This may assist a golfer in hitting a golf ball square, avoiding or preventing unintended slicing and/or hooking of the golf ball during play. The golf training club may also assist a golfer in initiating the swing with a minimal shaft lean towards the target during address when using an iron; and increasing the lean of the shaft at impact allowing a square clubface and a downward strike on the golf ball. This may allow for improved contact and further distances.

Figure 1:
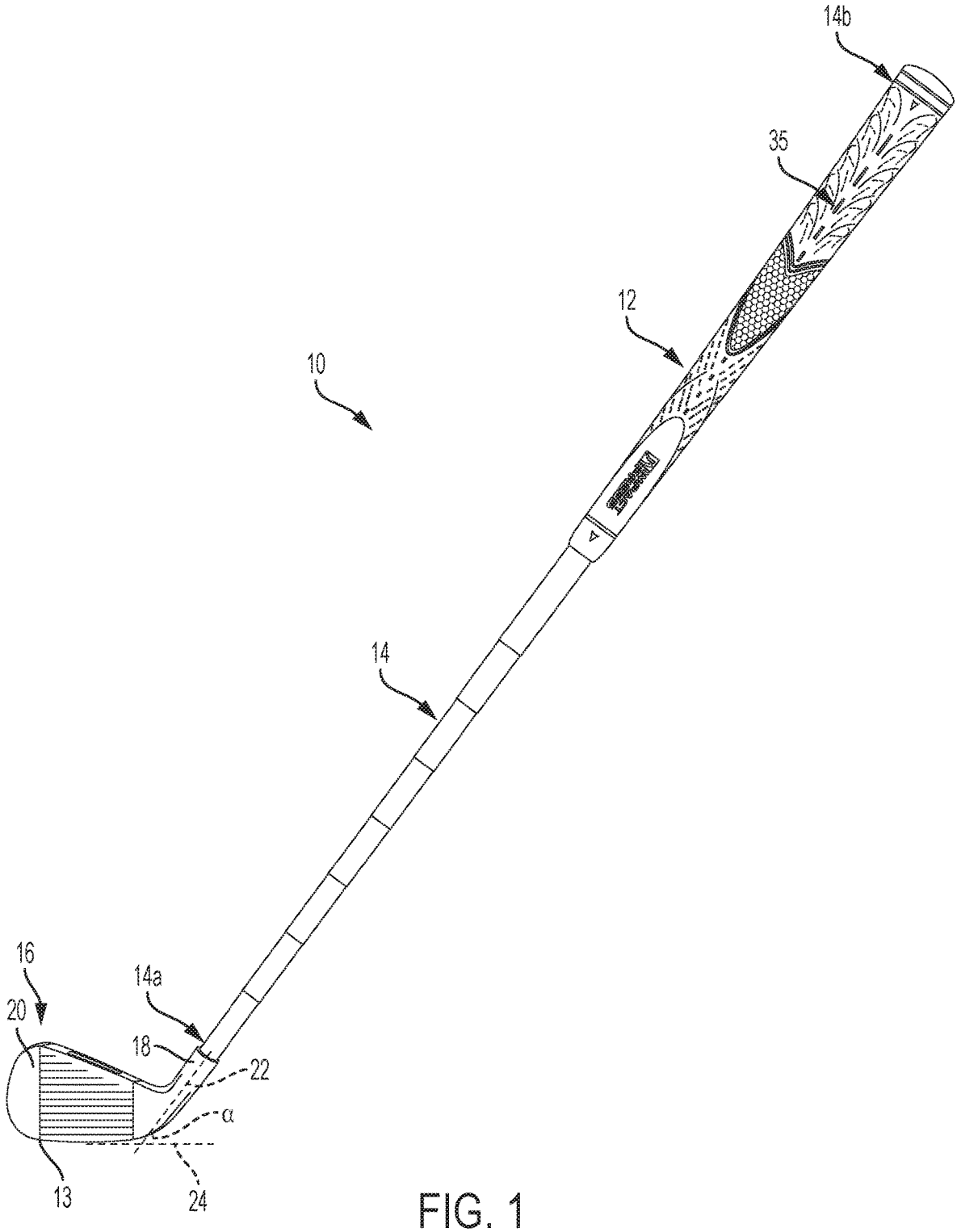
FIG. 1 is a perspective view of a golf club, according to an embodiment.

Referring to FIG. 1, a golf training aid is shown. The golf training aid may be a golf club 10 having modified geometry to facilitate its use as a training aid. The golf club 10 may be an iron. The golf club 10 may include a grip 12, shaft 14, and club head 16. The shaft 14 can include a distal end 14*a* and a proximal end 14*b*. The grip 12 may be coupled at the proximal end 14*b* of the shaft 14. The distal end 14*a* of the shaft 14 can be coupled to a hosel 18 of the club head 16. The hosel 18 may be substantially tubular such that the distal end 14*a* is secured within a bore of the hosel 18. The grip 12 may be formed of a material that allows for a firm yet comfortable grip of the golf club 10. Such materials may be, for example, plastic, rubber, leather, etc., or combinations thereof. The shaft 14 may be constructed of graphite, carbon fiber, steel, metal, composite, etc. The club head 16 may be metal, composite, steel, aluminum, stainless steel, graphite, etc., or combinations thereof.

With continued reference to FIG. 1, the club head 16 may define a club face 20 having a sole 13. The sole 13 may be the bottom of the club head 16. The sole 13 may be the portion of the club head 16 closest to or adjacent the ground during play. The golf club 10 may have a lie angle α. The lie angle α is the angle between the shaft 14 and the ground surface when the center of the sole 13 is touching the ground surface. For example, with reference to FIG. 1, the lie angle α may be the angle defined between an axis 22 and an axis 24. The axis 22 may be a longitudinal axis extending through a center of the shaft 14. The axis 24 may be a horizontal axis that is parallel with and aligned with a substantially flat and horizontal ground surface. The lie angle α may be between about 55 and about 75 degrees, for example, about 65 degrees.

Figure 2:
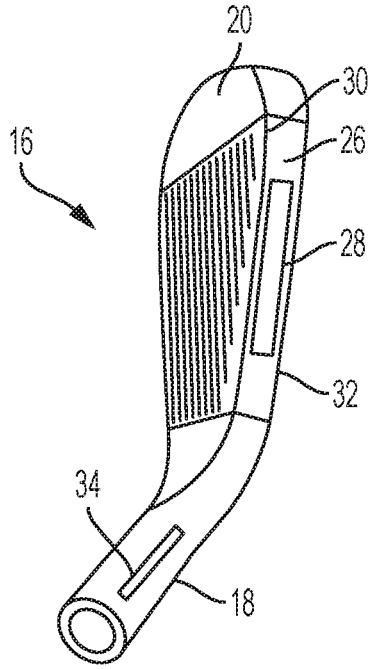
FIG. 2 is a top perspective view of the club head of the golf club of FIG. 1, according to an embodiment.

Referring now to FIG. 2, a top perspective view of the club head 16 is shown. The shaft 14 and grip 12 are removed for clarity. The club head 16 may have a top surface 26 at the top of the club face 20. The top surface 26 may have an impact alignment gauge 28 located thereon. The impact alignment gauge 28 may be positioned centrally between the top line 30 and a rear edge 32 of the top surface 26. The impact alignment gauge 28 may be substantially rectangular, although other shapes are contemplated. The impact alignment gauge 28 may be etched, machined, embossed, or otherwise formed on the top surface 26 of the club head 16. Alternatively, the impact alignment gauge 28 may be formed as a separate component (such as a sticker) and adhered or otherwise secured to the top surface 26. According to an embodiment, the impact alignment gauge 28 may be 2 inches long by 0.125 inches wide.

With continued reference to FIG. 2, the hosel 18 may have an address alignment gauge 34. The address alignment gauge 34 may be positioned on an outer surface of the hosel 18. The address alignment gauge 34 may be substantially rectangular, although other shapes are contemplated. The address alignment gauge 34 may be etched, machined, embossed, or otherwise formed on the hosel 18. Alternatively, the address alignment gauge 34 may be formed as a separate component (such as a sticker) and adhered or otherwise secured to the hosel 18. According to an embodiment, the address alignment gauge 34 may be 1 inch long by 0.125 inches wide.

Alternatively, or additionally, the grip 12 may have an address alignment gauge 35 (see FIG. 1). The address alignment gauge 35 may be positioned on an outer surface of the grip 12. The address alignment gauge 35 may be a dashed line, an arrow, a solid line, rectangle, or other shape. The address alignment gauge 35 may be painted, molded, or otherwise formed on the grip 12. The address alignment gauge 34 and the address alignment gauge 35 may be used separately or in combination.

Figure 3:
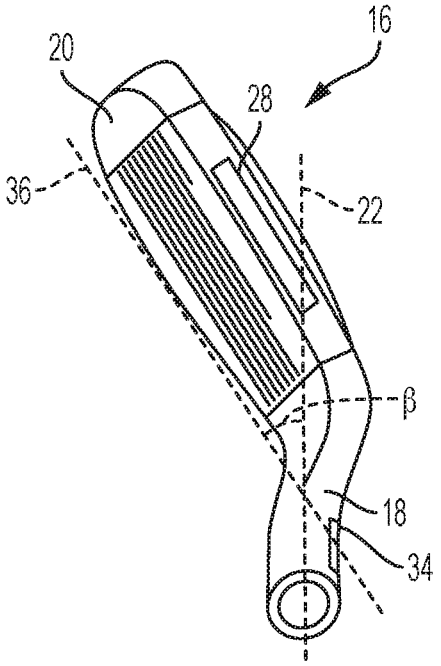
FIG. 3 is another top perspective view of the club head of FIG. 2, according to an embodiment.

Referring to FIG. 3, a top perspective view of the club head 16 is shown. The club face 20 of the club head 16 may define an axis 36. The axis 36 may pass through a tangent point on the leading edge of the club head 16. For example, the axis 36 may be substantially parallel to the leading edge of the club head 16. Additionally, the axis 36 may be parallel to the scoring lines on the club face 20. The axis 36 may form a face angle β with the axis 22. The face angle β may be selected such that the club face 20 is in a normally closed position with respect to a golf ball (not depicted) at address when the when the center of the sole 13 is touching the ground surface. The face angle β may be between about 20 degrees to about 40 degrees. The face angle β may be about 30 degrees. The golf club 10 may be constructed such that the lie angle α is between about 55 and about 75 degrees, for example, about 65 degrees, and the face angle β is between about 20 and about 40 degrees, for example, about 30 degrees. Thus, when the golf club 10 is held such that the club face 20 is in the about 30 degree closed position with respect to the ball (not depicted) during address, the center of the sole 13 is in contact with the ground surface. This may be possible due to the lie angle α being between about 55 and about 75 degrees.

Figure 4:
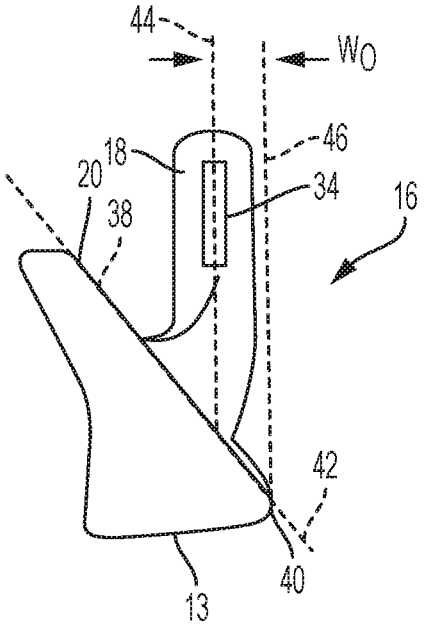
FIG. 4 is a front view of the club head of FIG. 2, according to an embodiment.

Referring to FIG. 4, a front view of the club head 16 is shown. The club face 20 defines a plane 38. The plane 38 is substantially aligned with and parallel with the club face 20. An axis 42 extends parallel with the plane 38 and may be substantially aligned with the club face 20. The club face 20 may have a forward most point 40, or leading edge. An axis 46 may be defined through the forward most point 40 and parallel to the axis 44. The axis 44 may extend through the hosel 18 and may be the same as or parallel to the axis 22. The distance $W_o$ between the axis 44 and 46 may define an offset. The distance $W_o$ may be about 0.10 inches to about 0.30 inches, for example, about 0.20 inches. The offset $W_o$ may be the lateral distance between the forward most point 40 and the centerline of the hosel 18. The club head 16 may also have a loft angle defined between the plane 38 and the axis 44. The loft angle may be between about 25 degrees and about 32 degrees, for example, about 29 degrees.

Figure 5:
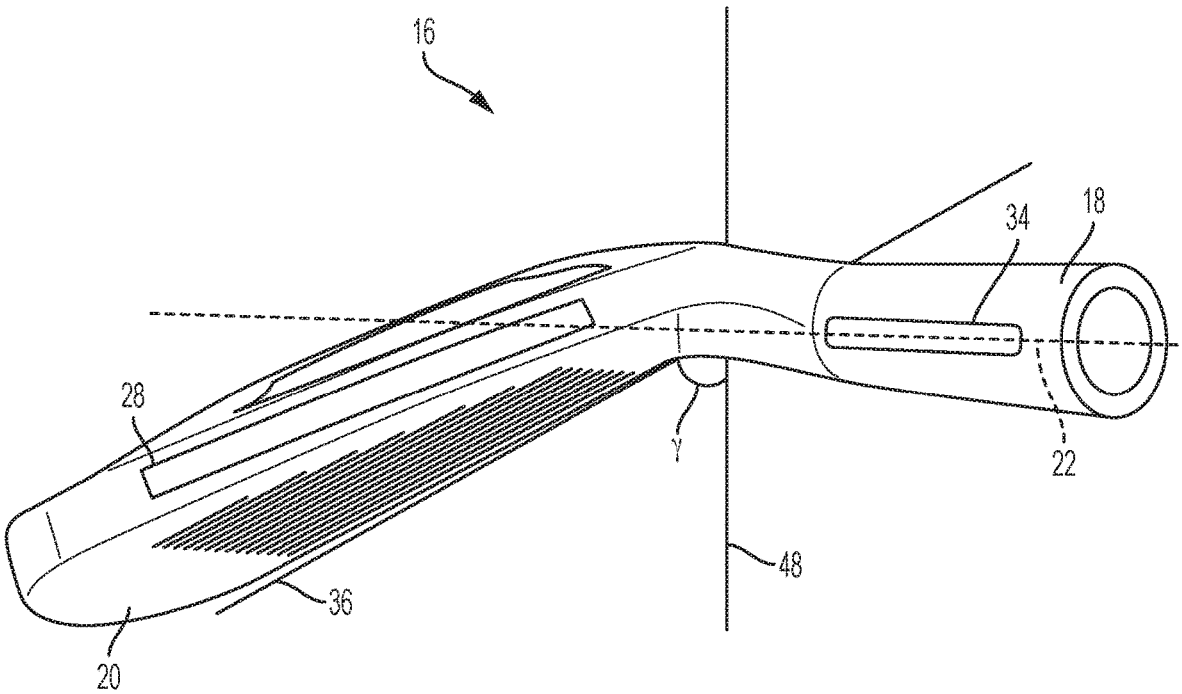
FIG. 5 is another top perspective view of the club head of FIG. 2, according to an embodiment.
Figure 6B:
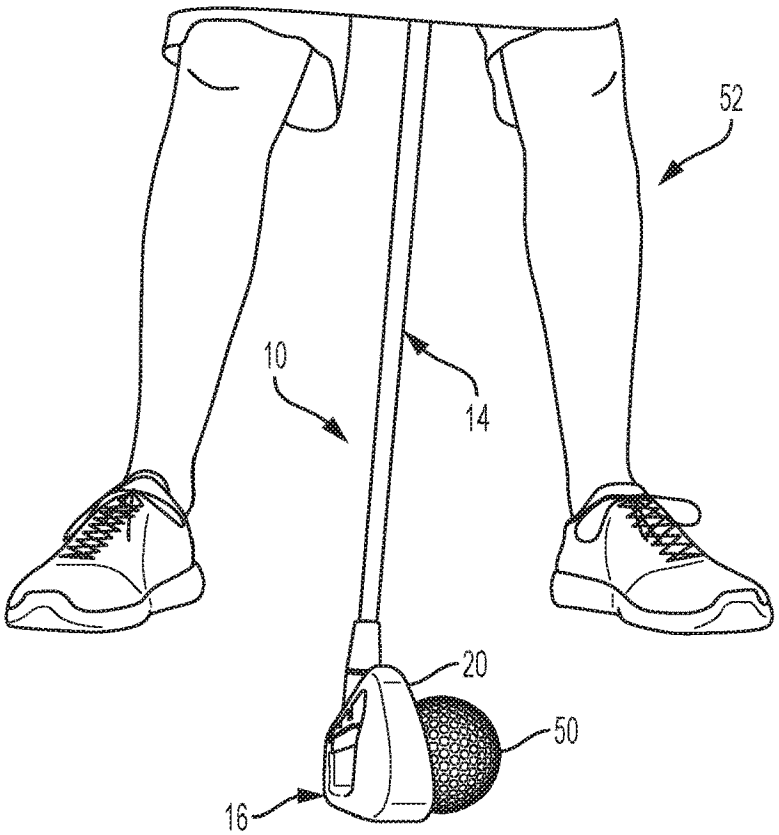
FIG. 6B is a front perspective view of a golf club in the address position of FIG. 6A, according to an embodiment.
Figure 6A:
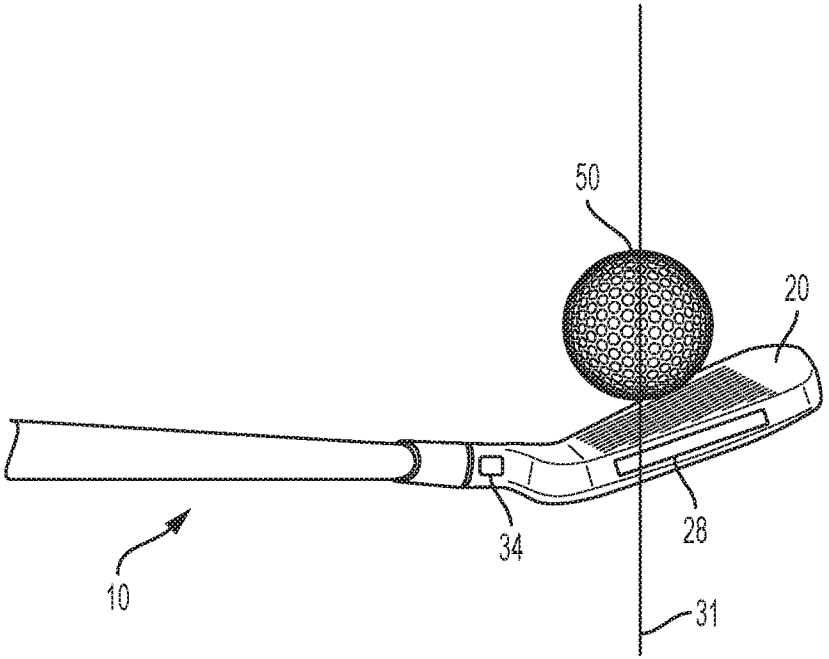
FIG. 6A is a top perspective view of a golf club in an address position, according to an embodiment.
Figure 6D:
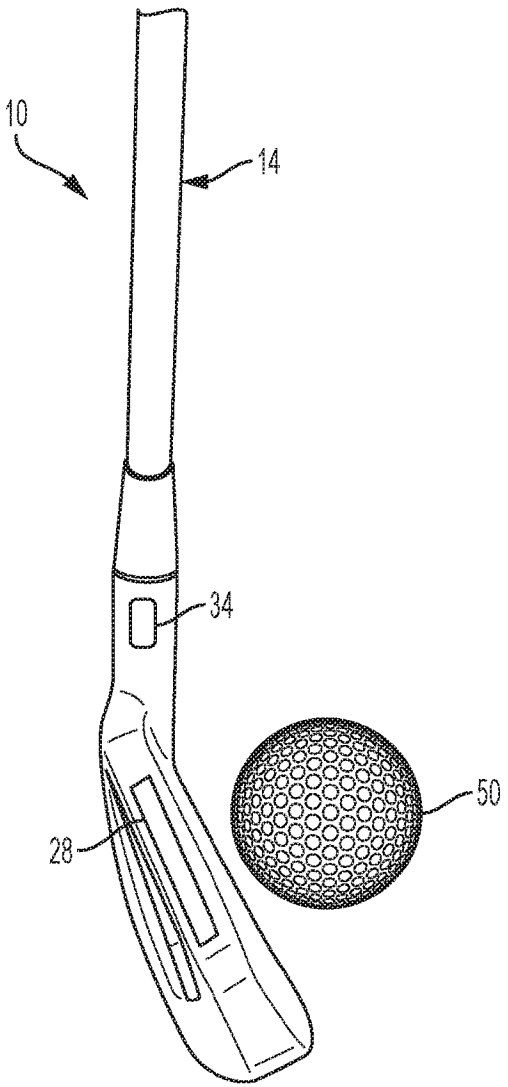
FIG. 6D is a top perspective view of a golf club in the address position of FIG. 6A, according to an embodiment.
Figure 6C:
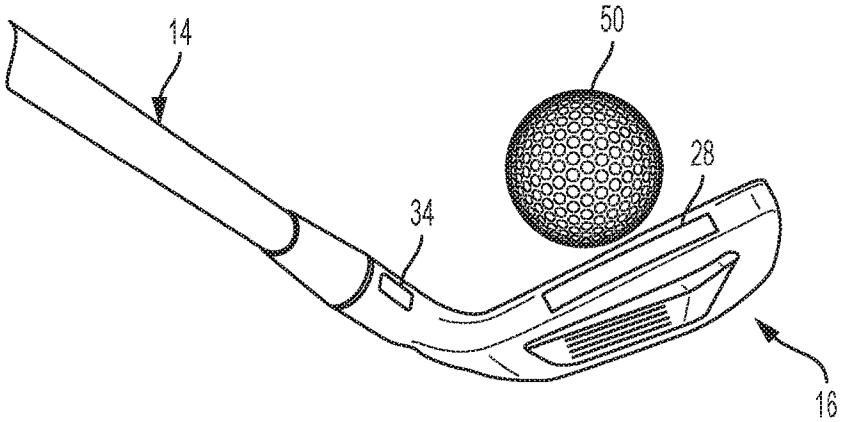
FIG. 6C is a down the line perspective view of a golf club in the address position of FIG. 6A, according to an embodiment.

Referring now to FIG. 5, a top view of the club head 16 is shown. A heel of the club head 16 may define a point (not depicted). A vertical line 48 through the heel and an axis 36 tangent to the club face 20 near the heel may define an angle γ. The angle γ may be between about 50 degrees and about 70 degrees, for example, about 60 degrees. The address alignment gauge 34 may be formed symmetrically about the axis 22 of the shaft 14. As will be described in more detail, the impact alignment gauge 28 and the address alignment gauge(s) 34, 35 may both be in the line of sight of a golfer when the golfer holds the golf club 10 in the address position.

With the structure of the golf club 10 described, a method or process of using the golf club 10 may be appreciated. With reference to FIGS. 6A-6D, the golf club 10 may be seen at various angles in the address position. The address position is the position at which a golfer aligns the golf club 10 with a golf ball 50. Referring to FIGS. 7A-7D, the golf club 10 may be seen at various angles in the impact position. The impact position is the position at which the golfer impacts the golf ball 50 with the club face 20 of the golf club 10.

Referring first to FIGS. 6A-6D, the golfer 52 (FIG. 6B) may align the golf club 10 with the golf ball 50 in the address position and along a target line 31. In the address position, the club face 20 of the golf club 10 may be closed. That is, the club face 20 may be angled inward or toward the golf ball 50 with respect to the shaft 14, as best appreciated in FIGS. 6A and 6B. As previously described, the club face 20 may be angled inward, or closed, at about 20 degrees to about 40 degrees, for example about 30 degrees. Furthermore, with the club in the closed position, the sole 13 may rest on the ground such that the center or midpoint of the sole 13 is touching the ground. In the address position, both the address alignment gauge 34 (and/or the address alignment gauge 35) and the impact alignment gauge 28 are in the line of sight of the golfer 52. In the address position, the address alignment gauge(s) 34, 35 may point substantially perpendicular to the intended trajectory or target line 31 of the golf ball 50.

A golfer 52 in the address position may align the address alignment gauge 34 located on the club head and/or the address alignment gauge 35 located on the grip 12 such that they point substantially perpendicular to the trajectory or target line 31 of the golf ball 50. Once aligned in this manner, the impact alignment gauge 28 will be aligned at a closed angle to the golf ball 50. With the address alignment gauge(s) and the impact alignment gauge 28 properly aligned during address, the club face 20 will be closed with respect to the golf ball 50.

Figure 7B:
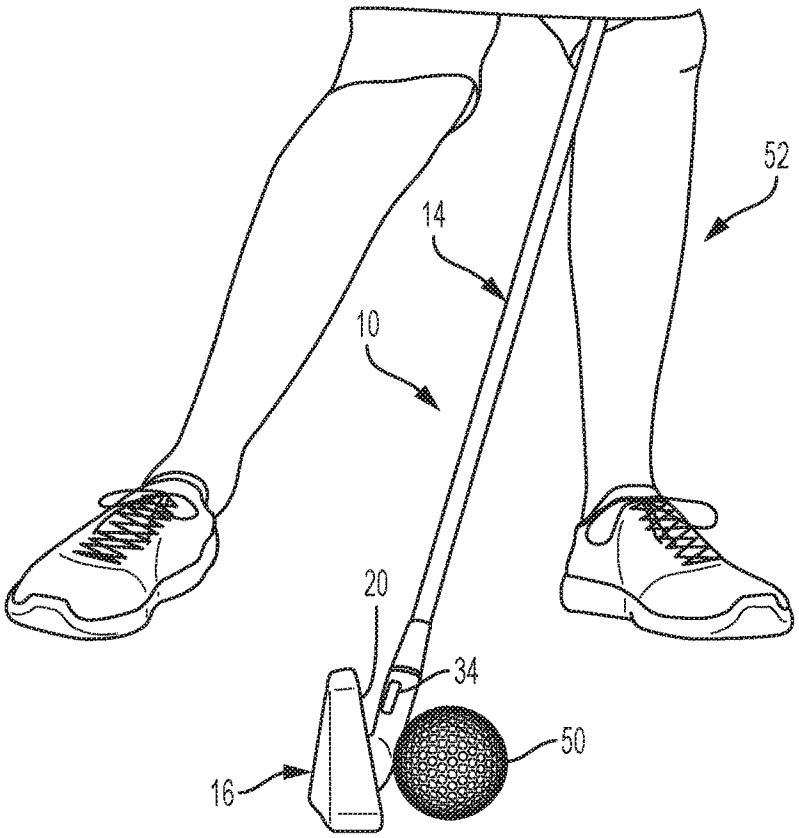
FIG. 7B is a front perspective view of a golf club in the impact position of FIG. 7A, according to an embodiment.
Figure 7A:
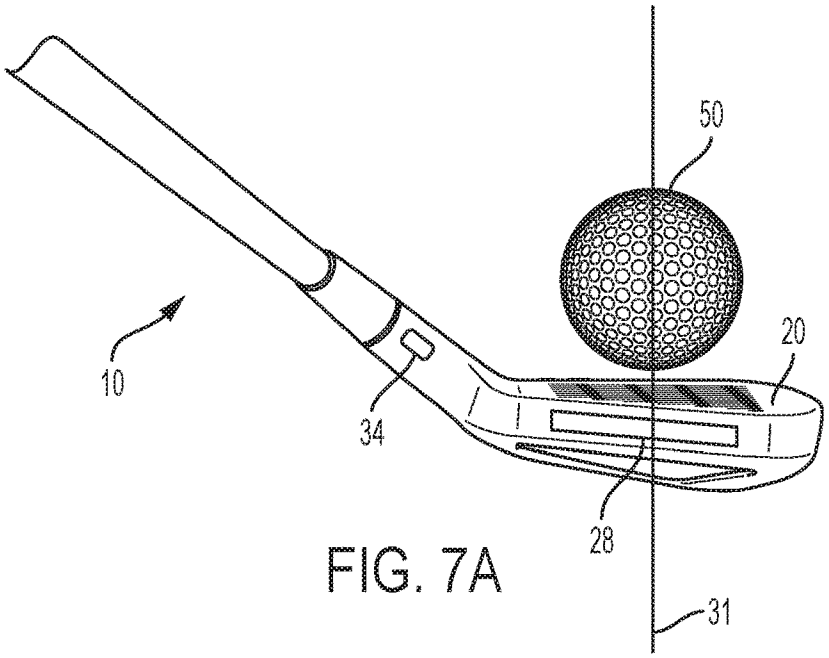
FIG. 7A is a top perspective view of a golf club in an impact position, according to an embodiment.
Figure 7D:
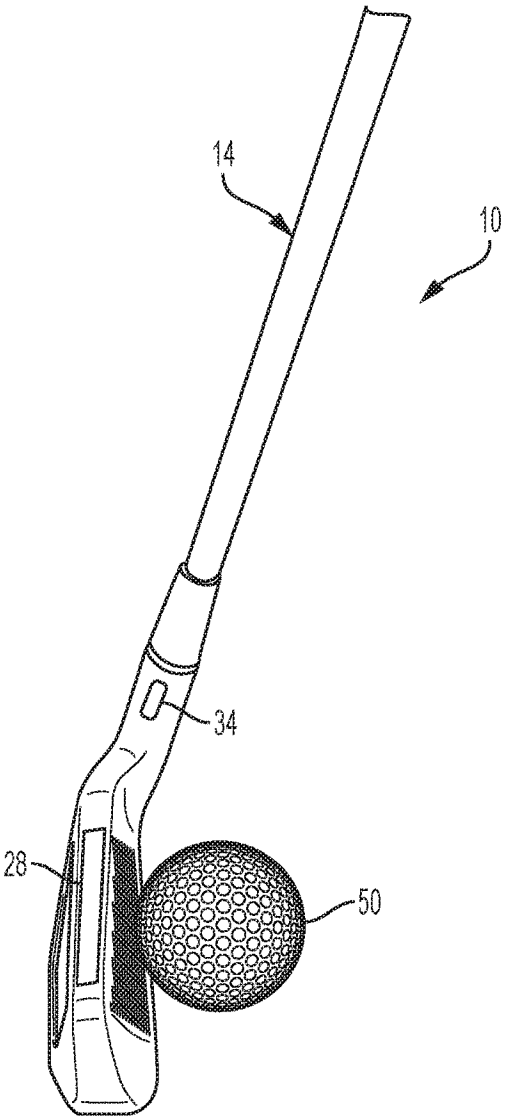
FIG. 7D is a top perspective view of a golf club in the impact position of FIG. 7A, according to an embodiment.
Figure 7C:
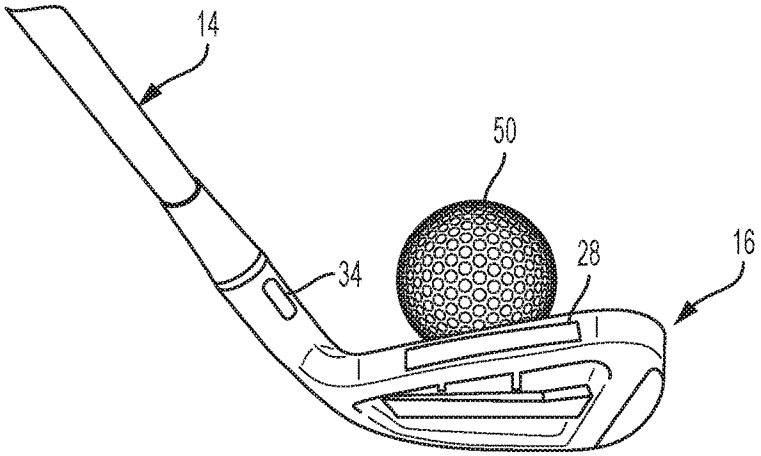
FIG. 7C is a down the line perspective view of a golf club in the impact position of FIG. 7A, according to an embodiment.

As the golfer 52 moves from the address position of FIGS. 6A-6D to the impact position of FIGS. 7A-7D, the golfer 52 will move, press, or push the shaft 14 forward or toward the golf ball 50, as best seen in FIG. 7B. At the impact position, the impact alignment gauge 28 may be aligned square with the golf ball 50. The impact alignment gauge 28 may be aligned substantially perpendicular to the intended trajectory or target line 31 of the golf ball 50. With the impact alignment gauge 28 aligned square with the golf ball 50, the club face 20 may also be aligned square with the golf ball 50.

To move from the address position to the impact position, the golfer 52 may slide the hips to being the transition towards the target. The golfer may have a weight distribution of 80/20 at impact. That is, 80% of the golfer's body weight is on the lead foot and 20% of the golfer's body weight is on the back foot. The golfer 52 may also have a flat leaning wrist at impact. The golfer 52 then tucks the pelvis and torso through the swing. This motion pushes the shaft forward, up, and outward to impact the golf ball 50 at a square location with the club face 20.

As the golfer 52 moves from the address position of FIGS. 6A-6D to the impact position of FIGS. 7A-7D, the golfer 52 moves the impact alignment gauge 28 such that it is substantially perpendicular to the intended trajectory or target line 31 of the golf ball 50. This moves the club face 20 from a closed position to a square position. That is, the club face 20 is altered from address to impact. This movement assists the golfer to impact the golf ball 50 in the proper manner, avoiding any unintended slice or hook. By providing a golf club having a normally closed face at address, the golfer may be induced to move their hips, legs, and body in a proper golf swing to align the club face square at impact. This may assist the golfer in impacting or correcting their golf swing. The movement of the golfer from address to impact may be improved by beginning with a normally closed club face. This movement may be further aided by use of the address and impact alignment gauges described herein.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

The invention claimed is:

1. A golf training club comprising:

a shaft having a proximal end and a distal end, the shaft defining a longitudinal axis;

a club head coupled to the distal end, the club head having a sole, a club face, and an upper surface; and an address alignment gauge extending along the longitudinal axis of the shaft, wherein the club face defines a closed face angle about the longitudinal axis of the shaft with respect to the address alignment gauge that is between about 20 degrees and about 40 degrees, and wherein a lie angle between the shaft and ground surface is between about 55 and 75 degrees.

2. The golf training club of claim 1, further comprising a grip attached to the proximal end of the shaft, wherein the address alignment gauge comprises a line extending along the grip.

3. The golf training club of claim 1, wherein the club head further includes a hosel, and the address alignment gauge comprises a line extending along the hosel.

4. The golf training club of claim 1, further comprising an impact alignment gauge that comprises a line extending along the upper surface of the club head.

5. The golf training club of claim 1, wherein the closed face angle is about 30 degrees.

6. The golf training club of claim 5, wherein the lie angle is about 65 degrees.

7. The golf training club of claim 1, wherein the sole of the club head defines a center, and the lie angle is the angle between the shaft and the ground surface when the center of the sole is touching the ground surface.

8. A golf training club, comprising:

a shaft having a proximal end and a distal end, the shaft defining a longitudinal axis;

a club head coupled to the distal end, the club head having a club face and an upper surface;

an address alignment gauge extending along the longitudinal axis of the shaft; and an impact alignment gauge extending along the upper surface of the club head, wherein the impact alignment gauge defines a closed face angle about the longitudinal axis of the shaft with respect to the address alignment gauge that is between about 20 degrees and about 40 degrees.

9. The golf training club of claim 8, further comprising a grip, wherein the address alignment gauge comprises a line extending along the grip, and the impact alignment gauge comprises a line extending along the upper surface of the club head.

10. The golf training club of claim 8, wherein the club head further comprises a hosel, and the address alignment gauge comprises a line extending along the hosel, and the impact alignment gauge comprises a line extending along the upper surface of the club head.

11. The golf training club of claim 8, wherein the closed face angle is about 30 degrees.

12. The golf training club of claim 1, wherein the closed face angle is defined when a center of the sole of the club face is touching the ground surface.

* * * * *